US008615974B2

(12) United States Patent
Suzuki et al.

(10) Patent No.: US 8,615,974 B2
(45) Date of Patent: Dec. 31, 2013

(54) BAGGING APPARATUS

(75) Inventors: Nobuhiro Suzuki, Fujisawa (JP); Michinori Watanabe, Fujisawa (JP); Shuichi Iribe, Fujisawa (JP); Seiichi Akutsu, Fujisawa (JP)

(73) Assignee: Oshikiri Machinery Ltd., Fujisawa-shi, Kanagawa-ken (JP)

( * ) Notice: Subject to any disclaimer, the term of this patent is extended or adjusted under 35 U.S.C. 154(b) by 452 days.

(21) Appl. No.: 12/892,238

(22) Filed: Sep. 28, 2010

(65) Prior Publication Data

US 2011/0072767 A1 Mar. 31, 2011

(30) Foreign Application Priority Data

Sep. 30, 2009 (JP) ..... 2009-228736

(51) Int. Cl.
*B65B 43/26* (2006.01)

(52) U.S. Cl.
USPC ..... 53/570; 53/573; 53/384.1; 53/574

(58) Field of Classification Search
USPC ..... 53/260, 261, 255, 258, 284.7, 385.1, 53/571, 574, 570, 573
IPC ..... B65B 025/16
See application file for complete search history.

(56) References Cited

U.S. PATENT DOCUMENTS

| | | | | | |
|---|---|---|---|---|---|
| 3,421,286 | A | * | 1/1969 | Chambless, Jr. | 53/570 |
| 3,451,192 | A | * | 6/1969 | Irwin | 53/58 |
| 4,671,048 | A | | 6/1987 | Rademacher | |
| 4,788,940 | A | * | 12/1988 | Forster | 119/71 |
| 5,322,477 | A | * | 6/1994 | Armington et al. | 493/346 |
| 5,477,662 | A | * | 12/1995 | Rompa | 53/571 |
| 5,743,071 | A | | 4/1998 | Wolthuizen | |
| 5,752,359 | A | * | 5/1998 | Oord | 53/381.2 |
| 6,421,984 | B1 | | 7/2002 | Murgatroyd et al. | |

* cited by examiner

*Primary Examiner* — Alexandra Elve
*Assistant Examiner* — Adam Moon
(74) *Attorney, Agent, or Firm* — Brinks Hofer Gilson & Lione

(57) ABSTRACT

An article bagging apparatus designed to reduce impacts caused by stopping at advance and retraction terminal points. The article bagging apparatus has an upper scoop (12) and a lower scoop (14) rectilinearly movable forward and backward together. The upper and lower scoops are advanced and inserted into a bag through an opening thereof, and the upper scoop is displaced upward, thereby expanding the bag vertically. In addition, the upper and lower scoops are retracted to pull the expanded bag, thereby allowing an article placed in the path of retraction to enter the bag. The article bagging apparatus includes a coupling unit (22) that allows the upper scoop to be displaced vertically and that causes the upper and lower scoops to move together forward and backward, an upper guide rail (24) supporting the upper scoop horizontally movably, and an upper drive unit (26) vertically moving the upper guide rail.

6 Claims, 4 Drawing Sheets

BAGGING APPARATUS

RELATED APPLICATIONS

This application claims priority under 35 U.S.C. §119 to Japanese Patent Application No. 2009-228736 filed on Sep. 30, 2009, the entire content of which is hereby incorporated by reference.

FIELD OF THE INVENTION

The present invention relates to an article bagging apparatus and, more particularly, to an apparatus for use in bread manufacturing to bag baked bread.

BACKGROUND OF THE INVENTION

Factory-produced bread products (loaves) are, in general, packaged individually in packaging bags for delivery.

Examples of the bread bagging technique are disclosed in for example, U.S. Pat. Nos. 4,671,048, No. 5,743,071 and No. 6,421,984.

These patents disclose bagging apparatuses, respectively. These apparatuses each have an upper scoop and a lower scoop movable forward and backward together in a horizontal direction. The upper scoop and the lower scoop are advanced and inserted into a bag through an opening thereof, and the upper scoop is displaced upward relative to the lower scoop, thereby expanding the bag vertically. In addition, the upper and lower scoops are retracted to pull the expanded bag in the direction of retraction of the upper and lower scoops, thereby allowing a loaf of bread placed in the path of retraction of the lower scoop to enter the bag through the opening.

The upper scoop needs to be moved forward and backward together with the lower scoop and to move vertically relative to the lower scoop. Therefore, a drive unit for vertically moving the upper scoop is installed on a carrier that moves forward and backward together with the upper and lower scoops supported thereon.

Consequently, the parts of the bagging apparatus that are moved forward and backward, including the upper and lower scoops, the drive unit and the carrier, are considerably heavy in weight. Therefore, if these heavy parts of the apparatus are moved forward and backward at high speed, large impacts always occur at the forward and backward ends of the movement. Accordingly, failures are likely to occur in the bagging apparatus, particularly in the power cable, air hose and so forth of the drive unit for the upper scoop.

SUMMARY OF THE INVENTION

An object of the present invention is to solve the problems associated with the apparatus for bagging loaves or other articles as stated above.

The present invention provides an article bagging apparatus having an upper scoop and a lower scoop. The upper scoop and the lower scoop are horizontally rectilinearly advanced together and inserted into a bag through an opening thereof, and the upper scoop is then displaced upward relative to the lower scoop, thereby expanding the bag vertically. Then, the upper and lower scoops are retracted together to pull the expanded bag in the direction of retraction of the upper and lower scoops, thereby allowing an article placed in the path of retraction of the lower scoop to enter the bag through the opening. The article bagging apparatus further includes a lower drive unit driving the lower scoop in a longitudinal direction along which the upper and lower scoops are advanced and retracted, a coupling unit that allows the upper scoop to be displaced vertically relative to the lower scoop and that couples together the upper and lower scoops so that the upper and lower scoops move together in the longitudinal direction, an upper guide rail supporting the upper scoop movably in the longitudinal direction, an upper drive unit vertically moving the upper guide rail, and a stationary frame supporting the upper drive unit and the lower drive unit. When the upper and lower scoops are about to enter the opening of the bag, the upper drive unit moves the upper guide rail down to lower the upper scoop toward the lower scoop, and when the upper and lower scoops have entered the bag, the upper drive unit moves the upper guide rail up to displace the upper scoop upward away from the lower scoop to expand the bag vertically. The terms "horizontally", "vertically", "upper", "lower" or the like are used herein to make it easy to understand the relative positional relationship among the parts of the bagging apparatus according to the present invention, but not to indicate any absolute positional relationship thereof.

In this article bagging apparatus, the mechanism for vertically moving the upper scoop is arranged as follows. The upper scoop is longitudinally movably provided on the upper guide rail, and the upper drive unit for vertically moving the upper guide rail is provided on the stationary frame. The upper drive unit is not moved and, therefore, the part of the bagging apparatus that is moved in the longitudinal direction can be reduced in weight to a considerable extent. Consequently, it is possible to reduce impacts occurring when the moving part of the apparatus stops at the advance and retraction terminal points, and hence possible to greatly improve the above-described problems associated with the conventional apparatus.

Specifically, the article bagging apparatus may include a lower carrier movable forward and backward horizontally with the lower scoop supported thereon, and an upper carrier movable forward and backward along the upper guide rail with the upper scoop supported thereon. The coupling unit may have an upper engaging member and a lower engaging member extending from the upper carrier and the lower carrier, respectively, and engaged with each other vertically slidably but not movably relative to each other in the longitudinal direction.

More specifically, the upper carrier may have at least two wheels spaced from each other in the longitudinal direction. The wheels may be rollably supported by the upper guide rail.

Even more specifically, the upper drive unit may have a servomotor supported by the stationary frame, and a link mechanism drivably connecting an output shaft of the servomotor and the upper guide rail to cause the upper guide rail to move vertically in response to an output from the output shaft. The link mechanism may be rotatably connected to the upper guide rail at two points spaced from each other in the longitudinal direction to support the upper guide rail horizontally.

The link mechanism may have a rotating shaft rotatably attached to the stationary frame being spaced from the output shaft of the servomotor in the longitudinal direction and extending parallel to the output shaft, and a sub-link mechanism drivably connecting the output shaft and the rotating shaft to apply to the rotating shaft the same rotation as that of the output shaft, and first and second arms of the same length that are secured to the output shaft and the rotating shaft, respectively, and that extend in the same angle direction with respect to the output shaft and the rotating shaft, the first and second arms being rotatably connected at their distal ends to the upper guide rail at two points spaced from each other in the longitudinal direction.

An embodiment of the present invention will be explained below with reference to the accompanying drawings.

DETAILED DESCRIPTION OF THE PREFERRED EMBODIMENTS

First, an outline of an article bagging apparatus 10 according to the present invention will be explained with reference to FIGS. 1*a* to 1*f*.

The article bagging apparatus 10 has an upper scoop 12 and a lower scoop 14 that are longitudinally movable forward and backward together in a horizontal direction. A bag-holding member H is installed at a position forward of the article bagging apparatus 10. The bag-holding member H holds a bag B placed thereon with its opening B' directed toward the article bagging apparatus 10. FIGS. 1*a* to 1*f* are drawings for illustrating the whole article-bagging process carried out for one bag B. In these figures, the bag-holding member H is shown to hold one bag B. In actual practice, however, the bag-holding member H is arranged to hold a large number of bags stacked thereon such that the uppermost one of the stack of bags is always at the height shown in the figures, and the process comprising the steps shown in FIGS. 1*a* to 1*f* is repeated to sequentially perform article bagging for the plurality of bags.

Figure 1A:
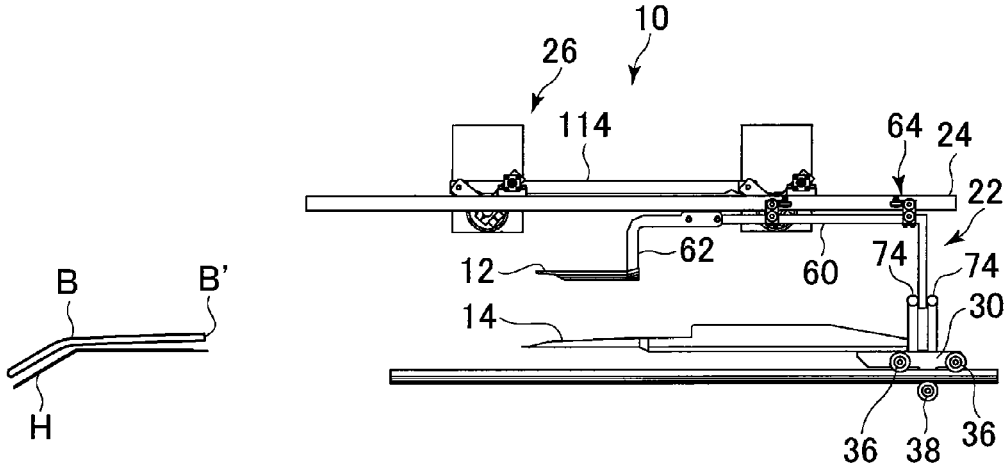
FIG. 1*a* is a diagram showing a state of an article bagging apparatus according to an embodiment of the present invention as applied to the bagging of loaves (blocks of bread) shown in FIGS. 1*a* to 1*f* before the article bagging operation is started, in which the article bagging apparatus is shown only with its main constituent parts.
Figure 1B:
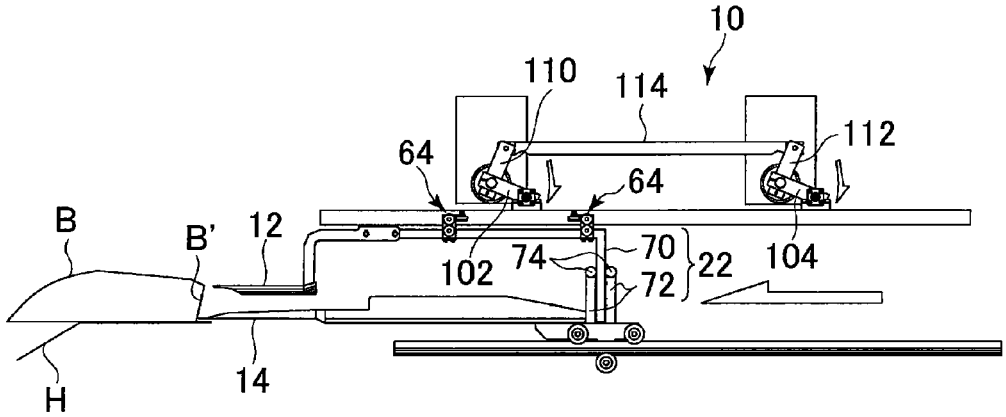
FIG. 1*b* is a diagram similar to FIG. 1*a*, showing a state of the article bagging apparatus after the starting of the bagging operation, in which a bag is inflated by air blown thereinto through its opening and an upper scoop is lowering toward a lower scoop and approaching the opening of the bag.
Figure 1C:
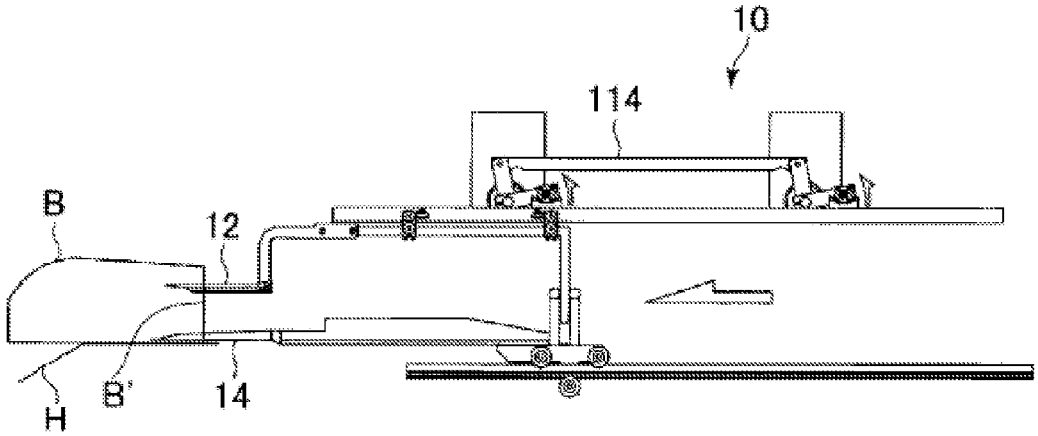
FIG. 1*c* is a diagram showing a state of the article bagging apparatus in which the upper and lower scoops have been moved from the position of FIG. 1*b* and inserted into the bag through the opening and the upper scoop has begun to move upward.

The upper scoop 12 and the lower scoop 14 that are in a retracted position (operation start position) shown in FIG. 1*a* are advanced toward the bag-holding member H by a drive mechanism (described later) as shown in FIG. 1*b*. At the same time, the upper scoop 12 is lowered to reduce the distance between the upper and lower scoops 12 and 14. Following this, air is blown toward the opening B' of the bag B from an air blower (not shown) to inflate the bag B, and thus the opening B' is opened. With the bag opening B' kept open in this position, the upper and lower scoops 12 and 14 positioned at a reduced mutual distance are inserted into the bag B through the opening B' as shown in FIG. 1*c*. When the upper and lower scoops 12 and 14 reach an advance terminating position shown in FIG. 1*d*, the upper scoop 12 is displaced upward to expand the bag B vertically. At this time, a loaf L of bread as an article to be bagged is placed on a portion of the lower scoop 14 that extends rearward from the bag B. Subsequently, the upper and lower scoops 12 and 14 are moved toward the retracted position as shown in FIG. 1*f*. During this movement, as shown in FIG. 1*e*, an L-shaped loaf stopper 16 is positioned in the retracting path of the lower scoop 14 to stop the loaf L from moving together with the lower scoop 14, thereby allowing the loaf L to be left in the bag B moved together with the lower scoop 14. When the upper and lower scoops 12 and 14 are returned to the retracted position, the lower scoop 14 separates rearward from the bag B containing the loaf L. The bag B containing the loaf L is carried out by a conveyor (not shown).

Figure 1D:
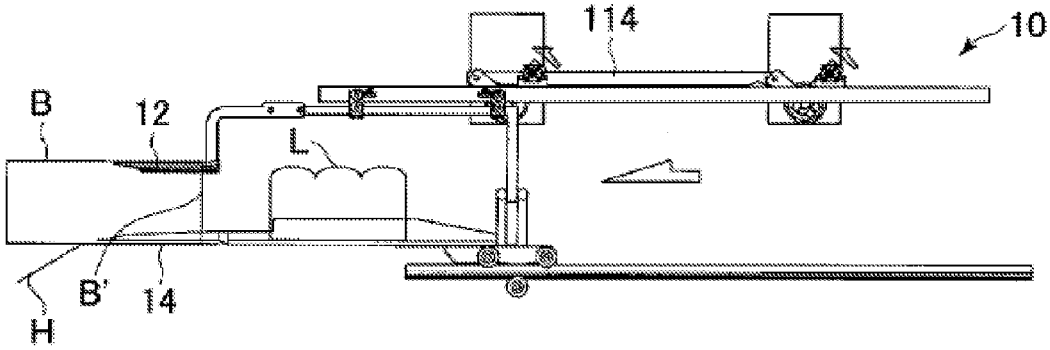
FIG. 1*d* is a diagram showing a state of the article bagging apparatus in which the upper and lower scoops have been further inserted into the bag from the position of FIG. 1*c* and the upper scoop in the bag has been moved upward away from the lower scoop, thereby causing the bag to be expanded vertically.
Figure 1E:
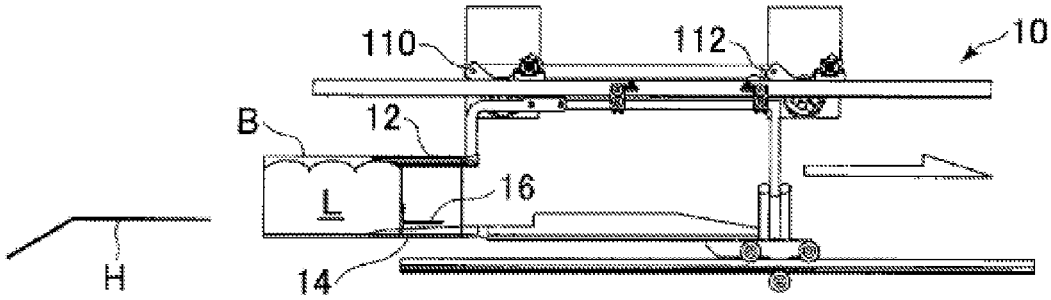
FIG. 1*e* is a diagram showing a state of the article bagging apparatus in which the upper and lower scoops have been retracted from the position of FIG. 1*d* together with the expanded bag to allow a loaf placed in the retraction path to enter the bag and in which a stopper has been engaged with the loaf.
Figure 1F:
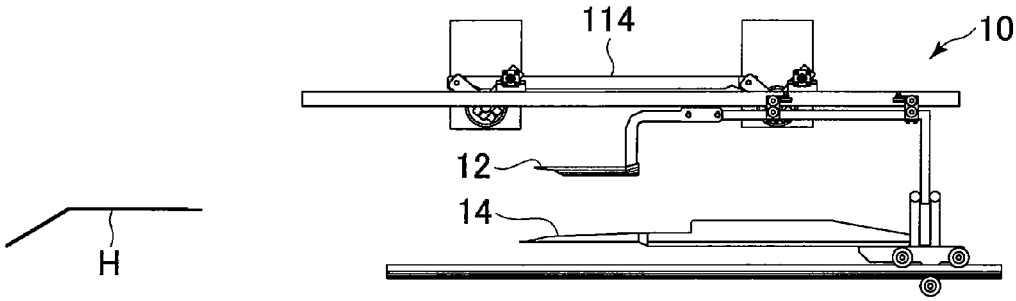
FIG. 1*f* is a diagram showing a state of the article bagging apparatus in which the upper and lower scoops have been retracted from the position of FIG. 1*e* to the position assumed before starting the operation, with the bag and the loaf therein left in the position shown in FIG. 1*e*, and the bag and the loaf have been carried out by an outfeed conveyor (not shown).

As shown in FIG. 1*d*, to supply the loaf L onto the lower scoop 14, a belt conveyor may be used that extends horizontally from the front side of the drawing sheet to a position close to the lower scoop 14 in a direction perpendicular to the direction of the longitudinal movement of the lower scoop 14 at substantially the same height as the retracting path of the lower scoop. To carry out the bagged loaf L, a belt conveyor may be used that extends horizontally from a position under the retracting path of the lower scoop toward the back side of the drawing sheet to receive the loaf L removed from the lower scoop 14 at the position shown in FIG. 1*e*.

Figure 2:
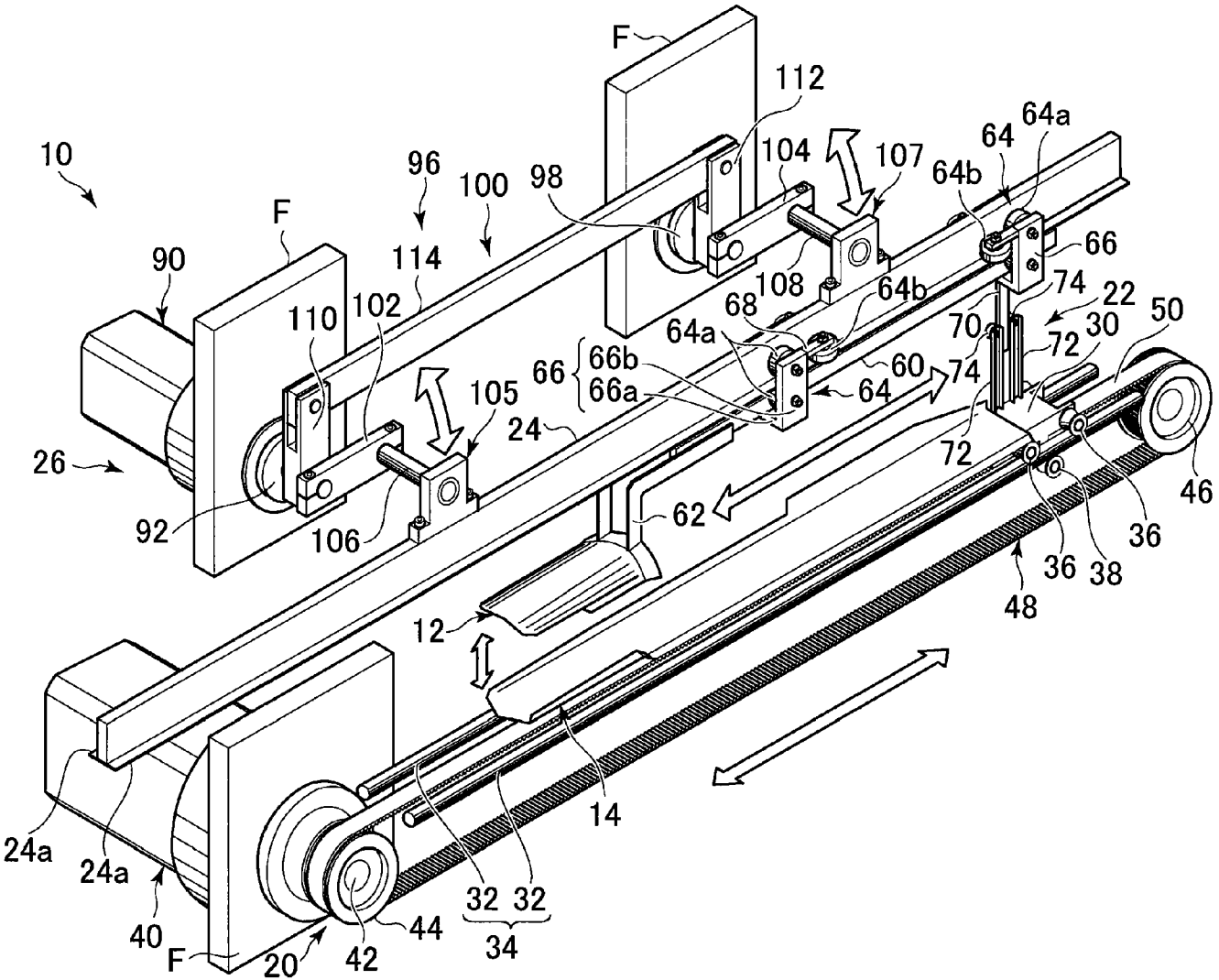
FIG. 2 is a perspective view showing a specific arrangement of the article bagging apparatus shown in FIGS. 1*a* to 1*f*.

As shown in FIG. 2, the article bagging apparatus 10 has a lower drive unit 20 driving the lower scoop 14 horizontally in the longitudinal direction, a coupling unit 22 (see FIG. 1*b*) that allows the upper scoop 12 to be displaced vertically relative to the lower scoop 14 and that couples together the upper scoop 12 and the lower scoop 14 so that the upper and lower scoops 12 and 14 move forward and backward together in the longitudinal direction, an upper guide rail 24 supporting the upper scoop 12 movably in the longitudinal direction, an upper drive unit 26 vertically moving the upper guide rail 24, and a stationary frame F supporting the upper drive unit 26 and the lower drive unit 20.

Specifically, the lower scoop 14 is an elongated plate-shaped member supported at the rear end thereof by a lower carrier 30 to extend horizontally forward. The lower carrier 30 is supported by a lower guide rail 34 comprising a pair of bar-shaped guide members 32 that extend horizontally in the longitudinal direction and that are laterally spaced from each other. The lower carrier 30 has, as shown clearly in FIGS. 1*a* to 1*f*, a pair of upper wheels 36 and one lower wheel 38 provided on each of the lateral sides thereof. The upper wheels 36 are rotatably engaged with the upper surface of the associated bar-shaped guide member 32. The lower wheel 38 is rotatably engaged with the lower surface of the bar-shaped guide member 32 at a mid-position between the two upper wheels 36. The lower carrier 30 is displaceable along the lower guide rail 34 by the upper and lower wheels 36 and 38.

The lower drive unit 20 has a servomotor 40 attached to the stationary frame F, a driving pulley 44 secured to an output shaft 42 of the servomotor 40, an idle pulley 46 set at a position rearward of the driving pulley 44, and an endless timing belt 48 passed over the driving pulley 44 and the idle pulley 46. The lower carrier 30 is coupled to an upper running portion 50 of the endless timing belt 48. The servomotor 40 is controlled so that the output shaft 42 is rotated forward and backward within a predetermined rotation range. In response to the rotation of the output shaft 42 of the servomotor 40, the upper running portion 50 of the endless timing belt 48 is periodically moved forward and backward in the longitudinal direction, and thus the lower carrier 30 is moved forward and backward, thereby driving the lower scoop 14 in the longitudinal direction.

The upper scoop 12 is a member slightly curved in cross-section that corresponds to the forward end portion of the lower scoop 14. The upper scoop 12 is connected through an inverted L-shaped connecting member 62 to the forward end portion of an elongated bar-shaped upper carrier 60 that is installed under and parallel to the upper guide rail 24 and that is suspended by the upper guide rail 24. The upper carrier 60 has a pair of guide wheel units 64 provided at respective longitudinally spaced positions to support the upper carrier 60 movably along the upper guide rail 24. Specifically, each guide wheel unit 64 has a U-shaped guide wheel support member 66 comprising a fixed lower portion 66*a* secured to the lower surface of the upper carrier 60 and upright portions 66*b* (FIG. 2 shows only one of the upright portions 66*b* that is closer to this side of the drawing sheet) extending upward from the right and left sides, respectively, of the fixed lower portion 66*a* along the opposite sides of the upper carrier 60. The guide wheel unit 64 further has a pair of vertically spaced guide wheels 64*a* provided on the inner side of each upright portion 66*b*. Each guide wheel 64*a* is rotatable about an axis extending horizontally in the lateral direction. The pair of guide wheels 64*a* are set to hold therebetween the corresponding one of right and left flanges 24*a* provided along the lower edge portion of the upper guide rail 24. Further, the guide wheel unit 64 has a guide wheel support member 68 extending horizontally from each upright portion 66*b* of the U-shaped guide wheel support member 66 to support a guide wheel 64*b* rotatably about a vertical axis. The guide wheel 64*b* is rotatably engaged with one side surface of the upper guide rail 24.

The coupling unit 22 has an upper engaging member 70 extending from the upper carrier 60 and a lower engaging member 72 extending from the lower carrier 30. The upper and lower engaging members 70 and 72 are engaged with each other vertically slidably but not horizontally movably relative to each other. The lower engaging members 72 comprise a pair of members set to hold the upper engaging member 70 from both sides. The pair of members have guide rollers 74 rotatably attached to their upper ends, respectively, to guide the upper engaging member 70.

The upper drive unit 26 has a servomotor 90 supported by the stationary frame F and a link mechanism 96 drivably connecting an output shaft 92 of the servomotor 90 and the upper guide rail 24 to cause the upper guide rail 24 to move vertically in response to the rotation of the output shaft 92.

The link mechanism 96 is rotatably connected to the upper guide rail 24 at two longitudinally spaced points to support the upper guide rail 24 horizontally. Specifically, the link mechanism 96 has a rotating shaft 98 rotatably attached to the stationary frame F being spaced rearward from and extending parallel to the output shaft 92 of the servomotor 90, a sub-link mechanism 100 drivably connecting the output shaft 92 and the rotating shaft 98 to apply to the rotating shaft 98 the same rotation as that of the output shaft 92, and first and second arms 102 and 104 of the same length that are secured to the output shaft 92 and the rotating shaft 98, respectively, and that extend in the same angle direction with respect to the output shaft 92 and the rotating shaft 98. The first and second arms 102 and 104 are connected at their distal ends to the upper guide rail 24 at two longitudinally spaced points. In the illustrated example, the first and second arms 102 and 104 are rotatably connected to brackets 105 and 107 secured to the upper guide rail 24 through horizontal connecting shafts 106 and 108, respectively.

The illustrated sub-link mechanism 100 has first and second links 110 and 112 of the same length that are secured to the output shaft 92 and the rotating shaft 98, respectively, and that extend in the radial direction of the shafts 92 and 98 in parallel to each other, and a connecting link 114 having two opposite ends rotatably connected to the respective distal ends of the first and second links 110 and 112. Thus, the sub-link mechanism 100 constitutes a parallel link mechanism.

In an article bagging operation, the servomotor 40 of the lower drive unit 20 is controlled to rotate the output shaft 42 forward and backward within a predetermined angle range, thereby causing the lower scoop 14 to move forward and backward. At the same time, the servomotor 90 of the upper drive unit 26 is controlled to rotate the output shaft 92 clockwise and counterclockwise within a predetermined angle range, thereby causing the upper scoop 12 to move up and down vertically. The upper scoop 12 and the lower scoop 14 are controlled as explained above with reference to FIGS. 1*a* to 1*f* by controlling the servomotor 90 of the upper drive unit 26 with respect to the rotation of the output shaft 42 of the servomotor 40 of the lower drive unit 20 at appropriate timing, thereby performing a bagging operation.

Although one embodiment of the present invention has been described above, the present invention is not limited to the foregoing embodiment. For example, the above-described sub-link mechanism is not limited to the illustrated one, but may take any other form, provided that the output shaft 92 and the rotating shaft 98 are drivably connected to apply to the rotating shaft 98 the same rotation as that of the output shaft 92.

What is claimed is:

1. An article bagging apparatus having an upper scoop and a lower scoop, wherein the upper scoop and lower scoop are horizontally advanced together and inserted into a bag through an opening of the bag, and the upper scoop is then displaced upward relative to the lower scoop, thereby expanding the bag vertically, and the upper scoop and lower scoop are retracted together to pull the expanded bag in a direction of retraction of the upper scoop and lower scoop, thereby allowing an article placed in a path of retraction of the lower scoop to enter the bag through the opening, the article bagging apparatus comprising:

a lower drive unit driving the lower scoop in a longitudinal direction along which the upper and lower scoops are advanced and retracted;

a coupling unit that couples together the upper scoop and lower scoop so that the upper scoop and lower scoop move together horizontally while allowing the upper scoop to be displaced vertically relative to the lower scoop;

an upper guide rail extending in the longitudinal direction and configured to support the upper scoop such that the upper scoop is movable along the upper guide rail in the longitudinal direction;

an upper drive unit vertically moving the upper guide rail; and a stationary frame immovably supporting the upper drive unit and lower drive unit;

wherein, when the upper scoop and the lower scoop are about to enter the opening of the bag, the upper drive unit moves the upper guide rail down to lower the upper scoop toward the lower scoop, and when the upper scoop and the lower scoop have entered the bag, the upper drive unit moves the upper guide rail up to displace the upper scoop upward away from the lower scoop to expand the bag vertically.

2. The article bagging apparatus of claim 1, further comprising:

a lower carrier movable in the longitudinal direction with the lower scoop supported thereon; and an upper carrier movable in the longitudinal direction along the upper guide rail with the upper scoop supported thereon;

the coupling unit having an upper engaging member and a lower engaging member extending from the upper carrier and the lower carrier, respectively, and engaged with each other vertically slidably but not movably relative to each other in the longitudinal direction.

3. The article bagging apparatus of claim 2, wherein the upper carrier has at least two wheels spaced from each other in the longitudinal direction, the wheels being rollably supported by the upper guide rail.

4. The article bagging apparatus of claim 3, wherein the upper drive unit has:

a servomotor supported by the stationary frame; and a link mechanism drivably connecting an output shaft of the servomotor and the upper guide rail to cause the upper guide rail to move vertically in response to an output from the output shaft.

5. The article bagging apparatus of claim 4, wherein the link mechanism is rotatably connected to the upper guide rail at two points spaced from each other in the longitudinal direction to support the upper guide rail horizontally.

6. The article bagging apparatus of claim 5, wherein the output shaft extends perpendicular to the longitudinal direction;

the link mechanism having:

a rotating shaft rotatably attached to the stationary frame, the rotating shaft being spaced from the output shaft of the servomotor in the longitudinal direction and extending parallel to the output shaft;

a sub-link mechanism drivably connecting the output shaft and the rotating shaft to apply to the rotating shaft a same rotation as that of the output shaft; and first and second arms of a same length that are secured to the output shaft and the rotating shaft, respectively, and that extend in a same angle direction with respect to the output shaft and the rotating shaft, the first and second arms being rotatably connected at their distal ends to the upper guide rail at two points spaced from each other in the longitudinal direction.

* * * * *